US008544600B2

(12) United States Patent
Kato et al.

(10) Patent No.: US 8,544,600 B2
(45) Date of Patent: Oct. 1, 2013

(54) EXHAUST DEVICE FOR INTERNAL COMBUSTION ENGINE

(75) Inventors: Takeo Kato, Wako (JP); Takeru Abe, Wako (JP); Tetsuya Takano, Wako (JP); Kohji Minami, Wako (JP); Masaya Yazaki, Wako (JP); Taichi Mori, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 13/414,766

(22) Filed: Mar. 8, 2012

(65) Prior Publication Data

US 2012/0228055 A1 Sep. 13, 2012

(30) Foreign Application Priority Data

Mar. 11, 2011 (JP) ..... 2011-053967

(51) Int. Cl.
*F01N 1/08* (2006.01)

(52) U.S. Cl.
USPC ..... 181/272; 181/239

(58) Field of Classification Search
USPC ..... 181/238, 239, 251, 253, 254, 257, 181/268, 272, 275
See application file for complete search history.

(56) References Cited

U.S. PATENT DOCUMENTS

| | | | | |
|---|---|---|---|---|
| 5,614,699 | A * | 3/1997 | Yashiro et al. | 181/254 |
| 5,708,237 | A * | 1/1998 | Maeda et al. | 181/254 |
| 5,917,161 | A * | 6/1999 | Fuhrmann | 181/237 |
| 5,929,398 | A * | 7/1999 | Amino et al. | 181/272 |
| 5,984,045 | A * | 11/1999 | Maeda et al. | 181/254 |
| 6,499,562 | B1 * | 12/2002 | Elfinger et al. | 181/251 |
| 2005/0224283 | A1 * | 10/2005 | Yokoi et al. | 181/268 |
| 2006/0037814 | A1 * | 2/2006 | Mabuchi et al. | 181/272 |
| 2007/0045043 | A1 | 3/2007 | Hoerr et al. | |

FOREIGN PATENT DOCUMENTS

| | | | |
|---|---|---|---|
| DE | 69832764 | T2 | 8/2006 |
| DE | 102005041692 | A1 | 3/2007 |
| DE | 102009054074 | A1 | 5/2011 |
| EP | 0902171 | A2 | 3/1999 |
| JP | 1-285615 | A | 11/1989 |

* cited by examiner

*Primary Examiner* — Jeremy Luks
(74) *Attorney, Agent, or Firm* — Birch, Stewart, Kolasch & Birch, LLP

(57) ABSTRACT

An exhaust muffler for improving the timbre of an exhaust sound in a low engine speed region and for increasing an engine output in a high engine speed region. In an exhaust device for an internal combustion engine for discharging an exhaust gas from the internal combustion engine through a multistage expansion type muffler having a plurality of expansion chambers for silencing the sound of the exhaust gas during the passage thereof, the multistage expansion type muffler includes a first tail pipe for communicating between a most downstream one of the expansion chambers and the outside of the muffler and a second tail pipe for communicating between an upstream one of the expansion chambers on the upstream side of the most downstream expansion chamber and the outside of the muffler.

16 Claims, 9 Drawing Sheets

EXHAUST DEVICE FOR INTERNAL COMBUSTION ENGINE

CROSS-REFERENCE TO RELATED APPLICATIONS

The present application claims priority under 35 USC 119 to Japanese Patent Application No. 2011-053967 filed Mar. 11, 2011 the entire contents of which are hereby incorporated by reference.

BACKGROUND OF THE INVENTION

1. Field of the Invention

The present invention relates to an exhaust device for an internal combustion engine for discharging an exhaust gas from the internal combustion engine through a multistage expansion type muffler having a plurality of expansion chambers for silencing the sound of the exhaust gas during the passage thereof.

2. Description of Background Art

A multistage expansion type muffler is know that includes a plurality of expansion chambers, a pipe for communicating between the expansion chambers, and a tail pipe, wherein the pressure of an exhaust gas from an internal combustion engine is reduced in each expansion chamber to thereby silence the sound of the exhaust gas. The exhaust gas, that is reduced in pressure, is discharged from the tail pipe to the outside of the muffler. See, for example, Japanese Patent Laid-open No. Hei 01-285615.

In the above conventional exhaust muffler, the exhaust sound of the exhaust gas to be discharged can be reduced by decreasing the diameter of each pipe. However, if the diameter of each pipe is too small, an engine output in a high engine speed region cannot be sufficiently drawn. Further, since the exhaust sound is small at low engine speeds in this case, it is difficult to adjust the timbre of the exhaust sound. In contrast, when the diameter of each pipe is increased, the engine output at high engine speeds can be easily sufficiently drawn. However, the sound pressure of the exhaust sound at low engine speeds becomes large.

As means for solving this problem, it has been proposed that an exhaust valve is provided so as to be switched according to engine speed, thereby making the exhaust sound and the engine output compatible with each other. However, this system is complicated in structure and costly.

SUMMARY AND OBJECTS OF THE INVENTION

It is an object of an embodiment of the present invention to provide an exhaust muffler having a simple structure that can improve the timbre of an exhaust sound in a low engine speed region and can also increase an engine output in a high engine speed region.

In accordance with the present invention, there is provided an exhaust device for an internal Combustion engine for discharging an exhaust gas from the internal combustion engine through a multistage expansion type muffler (1) having a plurality of expansion chambers (31, 33, 35) for silencing the sound of the exhaust gas during the passage thereof, wherein the multistage expansion type muffler (1) includes a first tail pipe (41) for communicating between a most downstream one (35) of the expansion chambers (31, 33, 35) and the outside of the muffler (1) and a second tail pipe (42) for communicating between an upstream one (33) of the expansion chambers (31, 33, 35) on the upstream side of the most downstream expansion chamber (35) and the outside of the muffler (1).

According to an embodiment of the present invention, the timbre of an exhaust sound in a low engine speed region can be improved and the engine output in a high engine speed region can also be increased.

Preferably, the opening area of the second tail pipe (42) is larger than the opening area of the first tail pipe (41).

With this configuration, the engine output in a low to medium engine speed region can be sufficiently drawn.

Preferably, the expansion chambers include first, second, and third expansion chambers (31, 33, 35) arranged in the order of passage of the exhaust gas. The most downstream expansion chamber is the third expansion chamber (35), the upstream expansion chamber is the second expansion chamber (33) and the volume of the second expansion chamber (33) is larger than the volume of the third expansion chamber (35).

With this configuration, a silencing effect in a low to medium engine speed region can be increased.

Preferably, the third expansion chamber (35) is provided between the first expansion chamber (31) and the second expansion chamber (33), and a small hole (51) for adjusting a back pressure is formed through a partition wall (21) between the first expansion chamber (31) and the third expansion chamber (35).

With this configuration, the back pressure can be finely adjusted.

Preferably, the sum of the opening area of the first tail pipe (41) and the opening area of the second tail pipe (42) is substantially equal to the opening area of an input pipe (36) of the muffler (1).

With this configuration, the timbre of an exhaust sound in a low engine speed region can be improved and the engine output in a high engine speed region can also be increased.

According to the present invention, the muffler includes the first tail pipe for communicating between the most downstream expansion chamber and the outside of the muffler and the second tail pipe for communicating between the upstream expansion chamber on the upstream side of the most downstream expansion chamber and the outside of the muffler. Accordingly, the timbre of an exhaust sound in a low engine speed region can be improved and the engine output in a high engine speed region can also be increased.

In the configuration wherein the opening area of the second tail pipe is larger than the opening area of the first tail pipe, the engine output in a low to medium engine speed region can be sufficiently drawn.

In the configuration wherein the expansion chambers include the first, second, and third expansion chambers, wherein the most downstream expansion chamber is the third expansion chamber, the upstream expansion chamber is the second expansion chamber, and the volume of the second expansion chamber is larger than the volume of the third expansion chamber, a silencing effect in a low to medium engine speed region can be increased.

In the configuration wherein the third expansion chamber is provided between the first expansion chamber and the second expansion chamber, and the small hole for adjusting a back pressure is formed through the partition wall between the first expansion chamber and the third expansion chamber, the back pressure can be finely adjusted.

In the configuration wherein the sum of the opening area of the first tail pipe and the opening area of the second tail pipe is substantially equal to the opening area of the input pipe of the muffler, the timbre of an exhaust sound in a low engine speed region can be improved and the engine output in a high engine speed region can also be increased.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

A preferred embodiment of the present invention will now be described with reference to the drawings wherein the exhaust device for the internal combustion engine according to the present invention includes an exhaust muffler mounted on a motorcycle.

Figure 1:
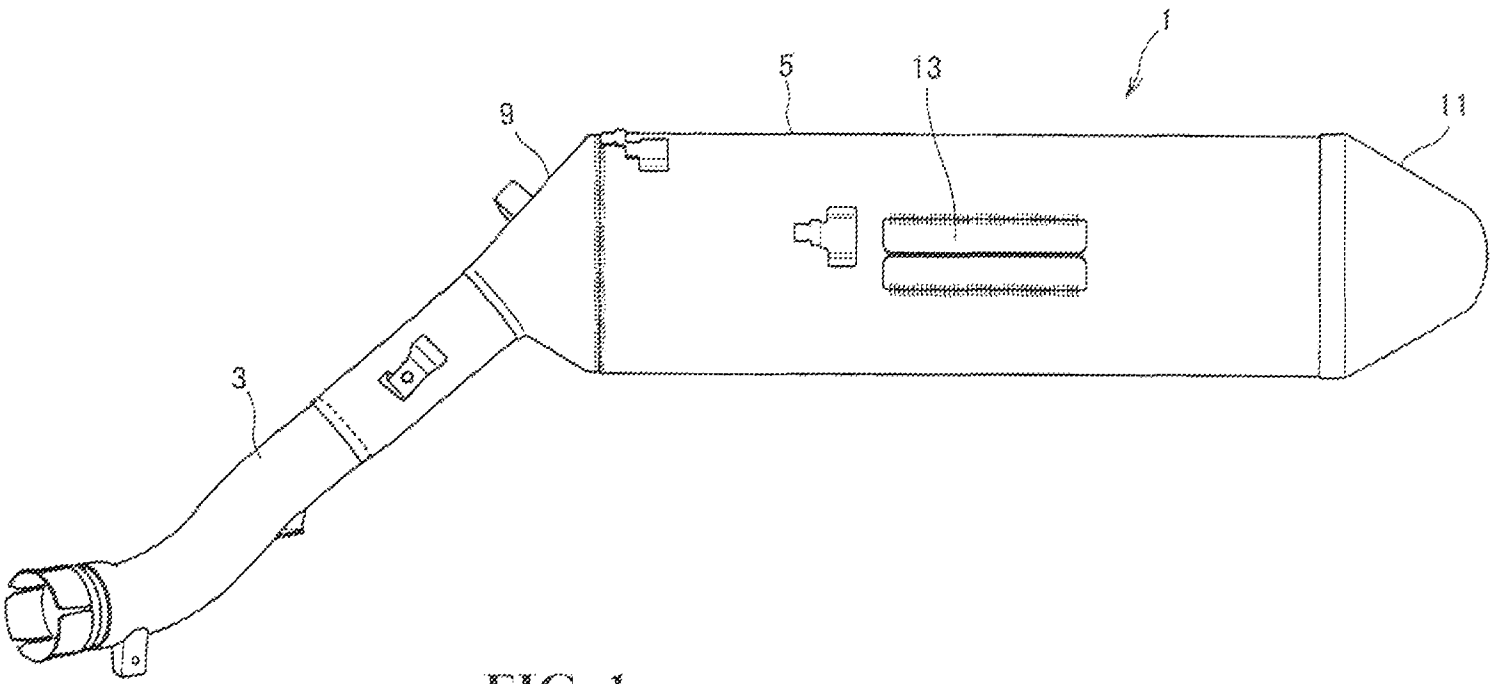
FIG. 1 is a top plan view of an exhaust muffler according to the present invention.

FIG. 1 is a top plan view of an exhaust muffler according to the present invention. The exhaust muffler 1 is connected to the rear end of an exhaust pipe (not shown) extending from an engine (not shown) of a motorcycle. An exhaust gas having high temperatures and high pressures is passed through the exhaust pipe and reduced in pressure by the exhaust muffler 1. The exhaust gas thus reduced in pressure is discharged from the exhaust muffler 1.

Figure 2:
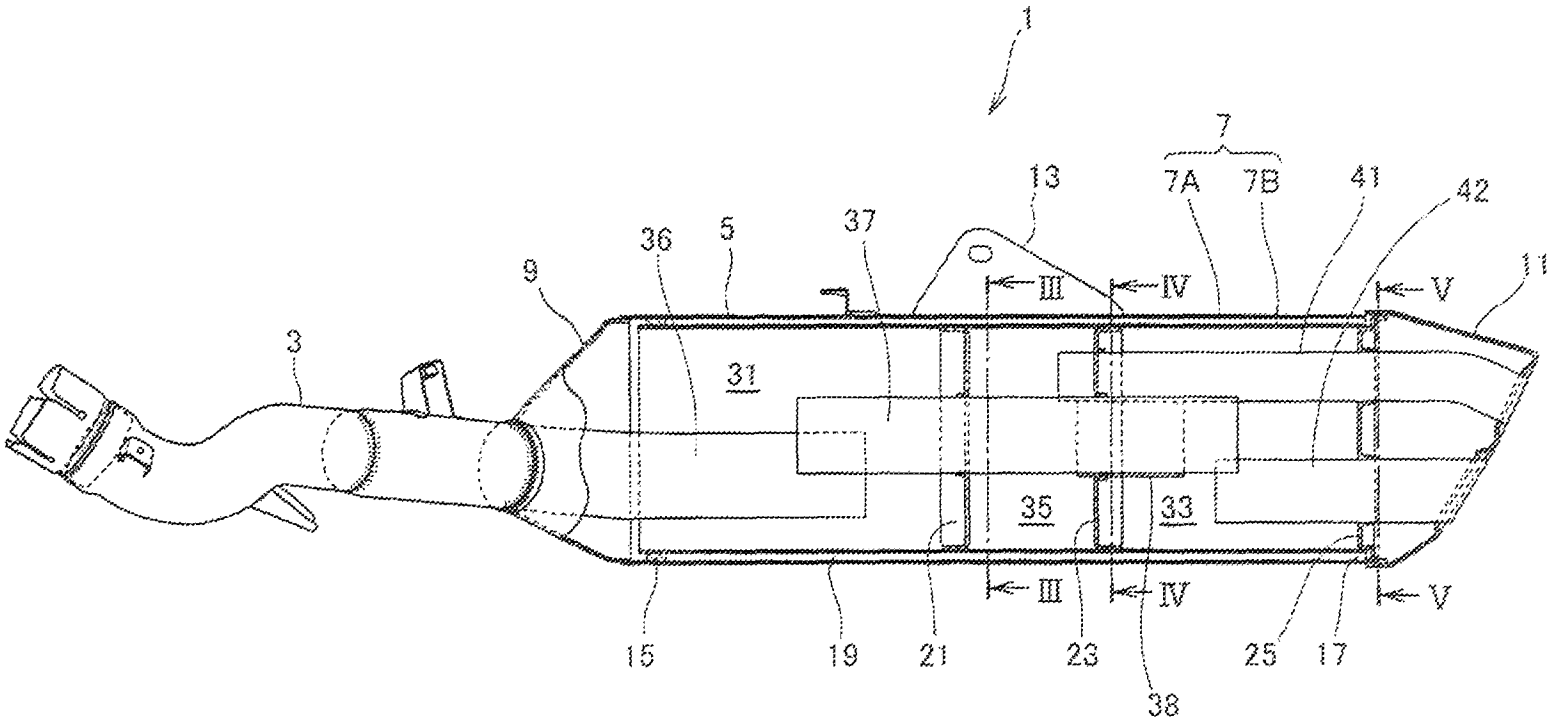
FIG. 2 is a partially sectional view of the exhaust muffler.

The exhaust muffler 1 is composed of a connection pipe 3 connected to the rear end portion of the exhaust pipe and a muffler body 5 connected to the rear end portion of the connection pipe 3. As shown in FIG. 2, the muffler body 5 includes a cylindrical portion 7 having front and rear openings, a front cap 9 for closing the front opening of the cylindrical portion 7, and a tail cap 11 for closing the rear opening of the cylindrical portion 7. A mounting flange 13 is provided on the outer surface of the cylindrical portion 7 at its longitudinally central portion. The exhaust muffler 1 is supported through this mounting flange 13 to the rear portion of a body frame (not shown) of the motorcycle.

The cylindrical portion 7 of the muffler body 5 has a double structure composed of an outer member 7A and an inner member 7B. The front end of the outer member 7A is connected to the rear end of the front cap 9. The rear end of the outer member 7A is connected to the front end of the tail cap 11.

The inner member 7B is supported inside the outer member 7A through front and rear supporting members 15 and 17. A sound insulating and heat insulating member 19, formed from material such as of glass wool, is provided between the outer member 7A and the inner member 7B.

A first partition wall 21 and a second partition wall 23 are provided in the inner member 7B so as to be spaced from each other in the axial direction of the cylindrical portion 7. A third partition wall 25 is provided at the rear end of the inner member 7B. The inside space of the muffler body 5 is partitioned by the partition walls 21, 23, and 25 into a first expansion chamber 31, a second expansion chamber 33, and a third expansion chamber 35. Thus, the exhaust muffler 1 is a multistage expansion type muffler having three expansion chambers.

The connection pipe 3 has a rear end portion 36 extending into the muffler body 5. The rear end portion 36 extends through the front cap 9 and opens into the first expansion chamber 31. A first communication pipe 37 is provided in the muffler body 5 so as to extend through the first partition wall 21 and the second partition wall 23, thereby communicating between the first expansion chamber 31 and the second expansion chamber 33. A second communication pipe 38 is provided in the muffler body 5 so as to extend through the second partition wall 23, thereby communicating between the second expansion chamber 33 and the third expansion chamber 35.

In this preferred embodiment, two tail pipes 41 and 42 are provided.

The first tail pipe 41 is a general tail pipe extending through the second partition wall 23, the third partition wall 25, and the tail cap 11, thereby communicating between the third expansion chamber 35 and the outside of the exhaust muffler 1. The second tail pipe 42 is an additional tail pipe extending through the third partition wall 25 and the tail cap 11, thereby communicating between the second expansion chamber 33 and the outside of the exhaust muffler 1.

Figure 3:
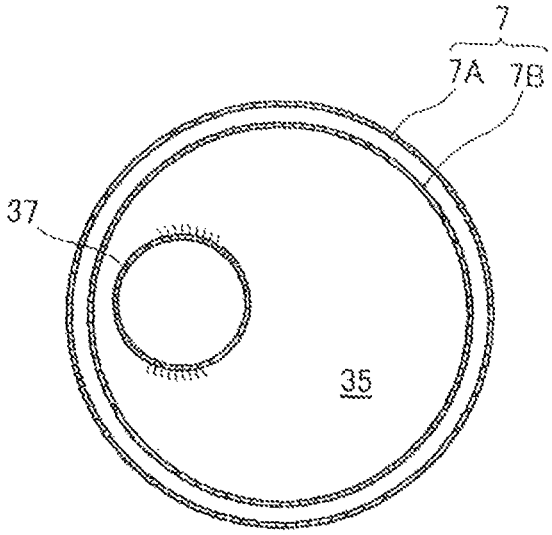
FIG. 3 is a cross section taken along the line in FIG. 2.
Figure 4:
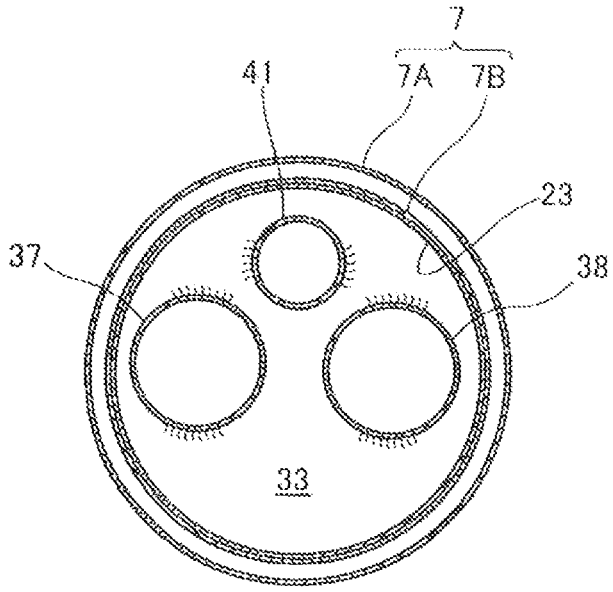
FIG. 4 is a cross section taken along the line IV-IV in FIG. 2.
Figure 5:
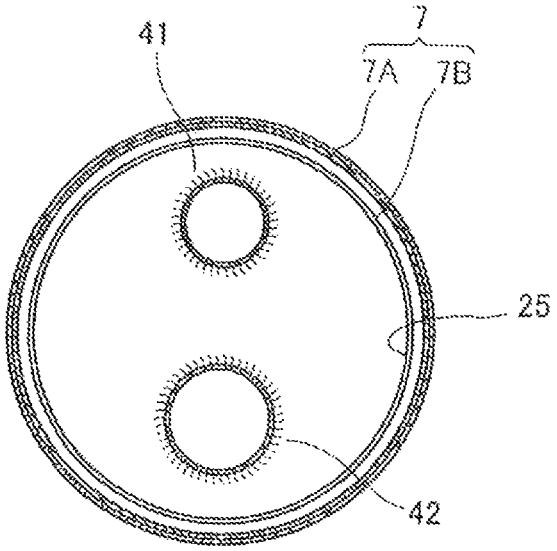
FIG. 5 is a cross section taken along the line V-V in FIG. 2.

FIG. 3 is a cross section taken along the line III-III in FIG. 2, FIG. 4 is a cross section taken along the line IV-IV in FIG. 2, and FIG. 5 is a cross section taken along the line V-V in FIG. 2.

As shown in FIGS. 2 to 4, the front end of the first communication pipe 37 opens into the first expansion chamber 31. The first communication pipe 37 extends through the first partition wall 21 and the second partition wall 23 in the muffler body 5 at a vertically central position on the left side (see FIG. 3). The rear end of the first communication pipe 37 opens into the second expansion chamber 33.

As shown in FIGS. 2 and 4, the rear end of the second communication pipe 38 opens into the second expansion chamber 33. The second communication pipe 38 extends through the second partition wall 23 in the muffler body 5 at a vertically central position on the right side (see FIG. 4). The front end of the second communication pipe 38 opens into the third expansion chamber 35.

As shown in FIGS. 2, 4, and 5, the front end of the first tail pipe 41 opens into the third expansion chamber 35. The first tail pipe 41 extends through the second partition wall 23 and the third partition wall 25 in the muffler body 5 at a laterally central position on the upper side (see FIGS. 4 and 5) and further extends through the tail cap 11 so as to be bent downward to the rear end thereof. The rear end of the first tail pipe 41 opens to the outside of the tail cap 11.

As shown in FIGS. 2 and 5, the front end of the second tail pipe 42 opens into the second expansion chamber 33. The second tail pipe 42 extends through the third partition wall 25 in the muffler body 5 at a laterally central position on the lower side (see FIG. 5) and further extends through the tail cap 11. The rear end of the second tail pipe 42 opens to the outside of the tail cap 11.

The rear end portion 36 of the connection pipe 3, the first communication pipe 37, and the second communication pipe 38 are formed from pipe members having substantially the same inner diameter. The inner diameter of the first tail pipe 41 is set smaller than that of the second tail pipe 42, and the inner diameter of each of the pipes 41 and 42 is set smaller than that of the second communication pipe 38. In other words, the first tail pipe 41 has the smallest inner diameter, and the second tail pipe 42 has the second smallest inner diameter. The sum of the opening areas of the first tail pipe 41 and the second tail pipe 42 is substantially the same as the opening area of the second communication pipe 38.

In comparing the sizes of the expansion chambers 31, 33, and 35, the first expansion chamber 31 has the largest volume, the second expansion chamber 33 has the second largest volume, and the third expansion chamber 35 has the smallest volume.

The operation of the exhaust muffler 1 will now be described with reference to FIG. 2.

The exhaust gas flowing through the connection pipe 3 into the muffler body 5 first enters the first expansion chamber 31 and next flows through the first communication pipe 37 into the second expansion chamber 33.

A part of the exhaust gas flowing into the second expansion chamber 33 is inverted in flowing direction to flow through the second communication pipe 38 into the third expansion chamber 35 and is next discharged through the first tail pipe 41 to the outside of the exhaust muffler 1. On the other hand, another part of the exhaust gas flowing into the second expansion chamber 33 is directly discharged through the second tail pipe 42 to the outside of the exhaust muffler 1.

Figure 6:
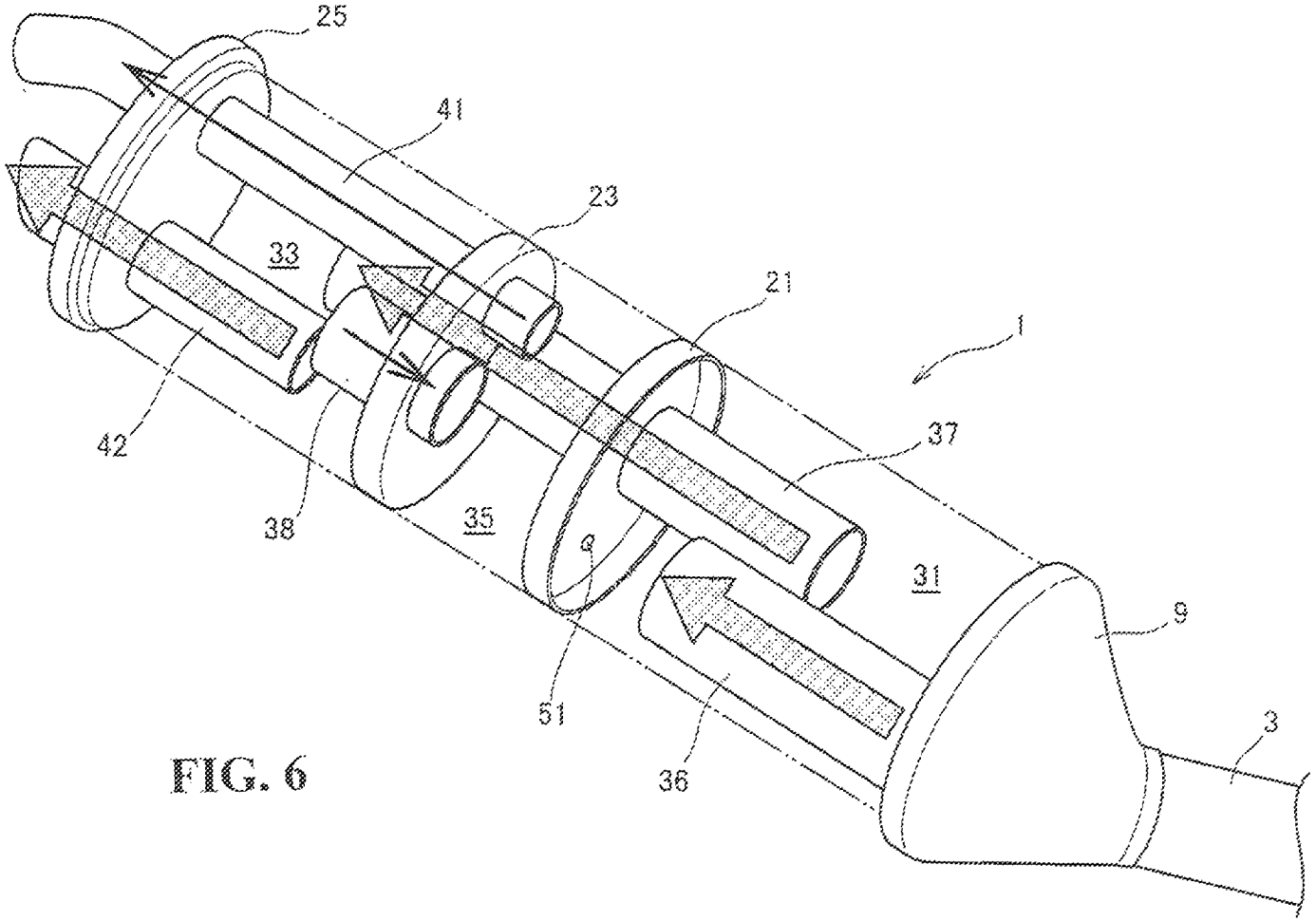
FIG. 6 is a schematic perspective view showing the flow of an exhaust gas in the exhaust muffler at low engine speeds.
Figure 7:
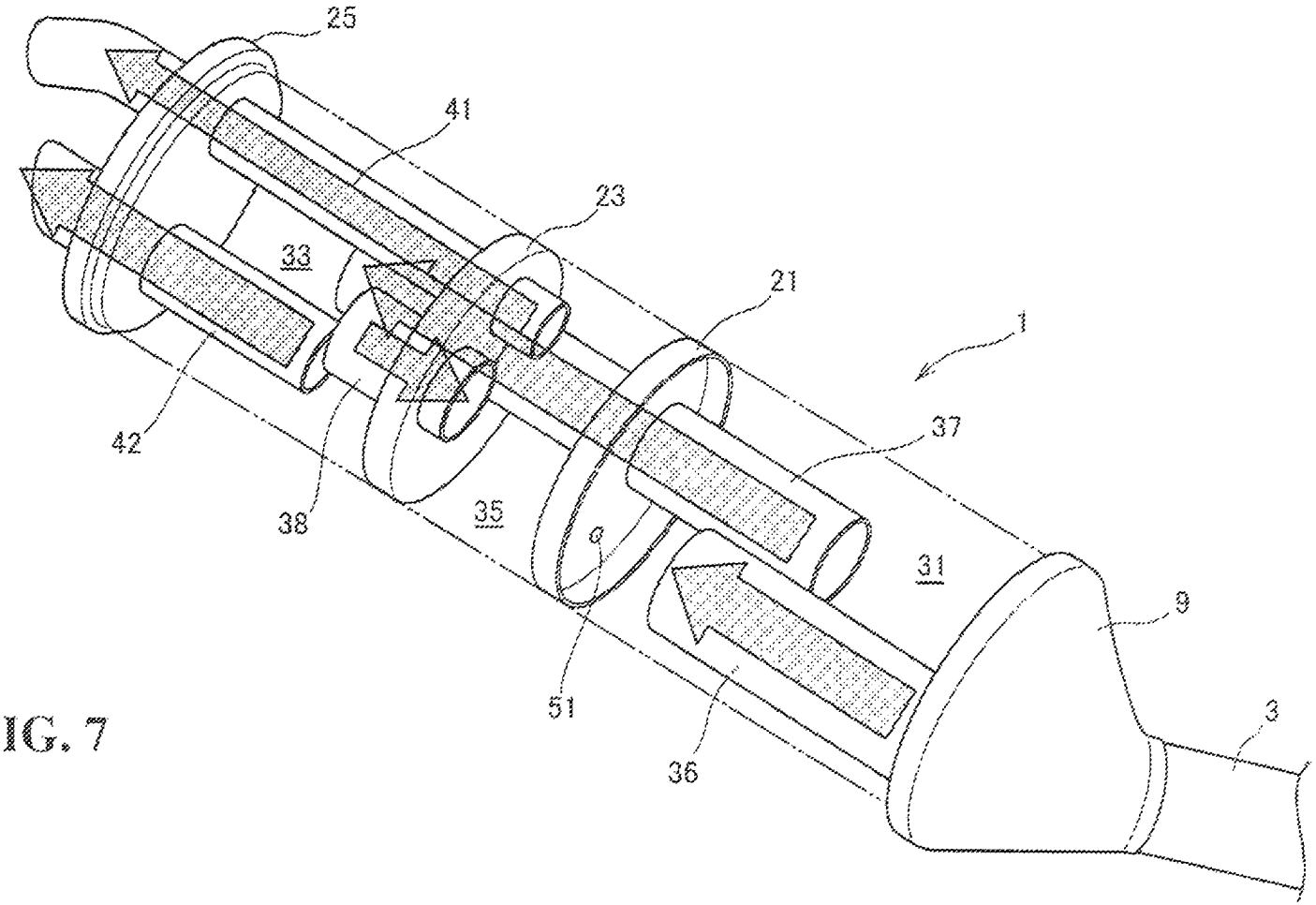
FIG. 7 is a schematic perspective view showing the flow of an exhaust gas in the exhaust muffler at high engine speeds.

FIGS. 6 and 7 schematically show the flow of the exhaust gas in the muffler body 5. FIG. 6 shows the flow at low engine speeds (the flow being shown by thin arrows because the amount of the exhaust gas flowing into the muffler body 5 is small). FIG. 7 shows the flow at high engine speeds (the flow being shown by thick arrows because the amount of the exhaust gas flowing into the muffler body 5 is large).

As shown in FIG. 6, the amount of the exhaust gas flowing into the first expansion chamber 31 of the muffler body 5 is small at low engine speeds. Accordingly, the amount of the exhaust gas flowing into the second expansion chamber 33 is also small and the back pressure in the second expansion chamber 33 is therefore low. When the back pressure in the second expansion chamber 33 is low, most of the exhaust gas is discharged through the second tail pipe 42 to the outside of the exhaust muffler 1.

In contrast, as shown in FIG. 7, the amount of the exhaust gas flowing into the second expansion chamber 33 is large at high engine speeds and the back pressure in the second expansion chamber 33 is therefore high. When the back pressure in the second expansion chamber 33 is high, a flow resistance acts on the exhaust gas flowing through the second tail pipe 42 because of its small diameter, so that the exhaust gas becomes hard to discharge through the second tail pipe 42 to the outside of the exhaust muffler 1. Accordingly, a part of the exhaust gas flowing into the second expansion chamber 33 is discharged through the second tail pipe 42 to the outside of the exhaust muffler 1, and another part of the exhaust gas flowing into the second expansion chamber 33 is inverted in flowing direction to flow through the second communication pipe 38 into the third expansion chamber 35 and is next discharged through the first tail pipe 41 to the outside of the exhaust muffler 1.

The present inventors measured an engine output in the case wherein the exhaust muffler 1 (having the two tail pipes 41 and 42) according to this preferred embodiment is mounted on the motorcycle and in the case wherein a conventional exhaust muffler (having a single tail pipe) is mounted on the motorcycle.

Figure 8:
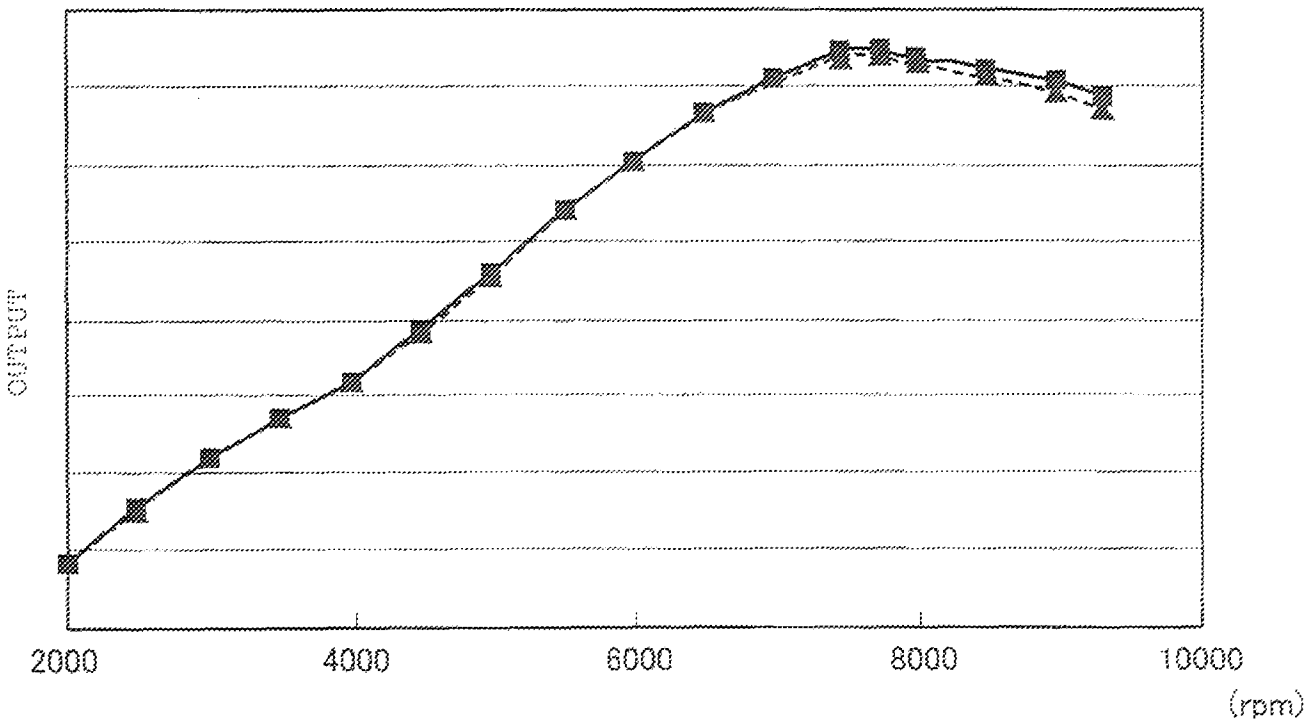
FIG. 8 is a graph showing the relation between engine speed and engine output.

FIG. 8 is a graph showing the relation between engine speed and engine output in the above cases. In FIG. 8, the characteristic curve shown by a solid line corresponds to the case wherein the exhaust muffler 1 according to this preferred embodiment is mounted on the motorcycle, and the characteristic curve shown by a broken line corresponds to the case wherein the conventional exhaust muffler without the second tail pipe 42 is mounted on the motorcycle.

When the engine speed is in a low speed region (2000 to 7000 rpm), the engine output in the case wherein the exhaust muffler 1 according to this preferred embodiment is mounted is substantially the same as that in the case wherein the conventional exhaust muffler is mounted.

However, when the engine speed is in a high speed region (7000 to 9500 rpm), the engine output in the case wherein the exhaust muffler 1 according to this preferred embodiment is mounted is improved over the engine output in the case wherein the conventional exhaust muffler is mounted.

Figure 9:
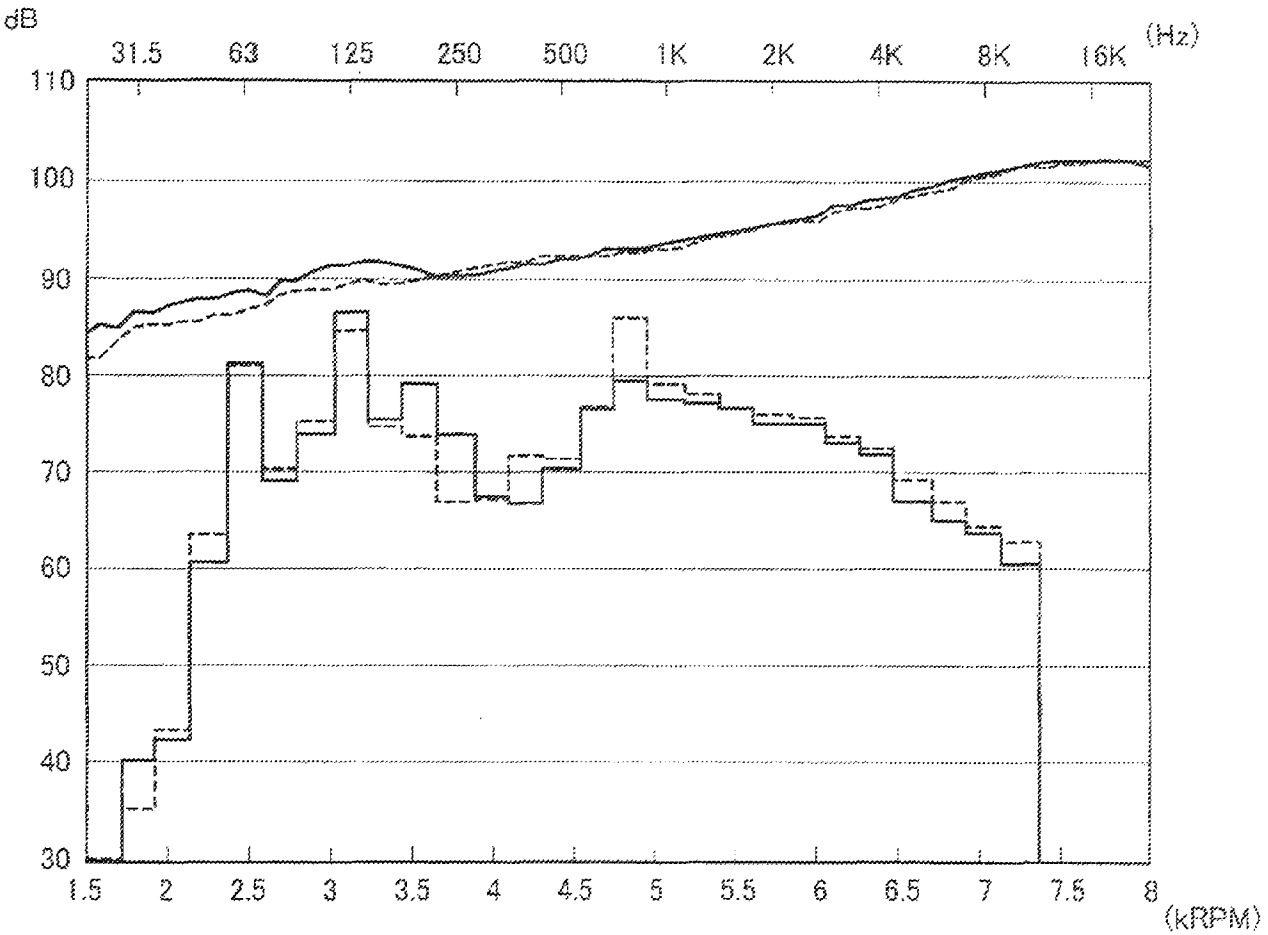
FIG. 9 is a graph showing the sound pressure of an exhaust sound and its frequency distribution.

FIG. 9 is a graph showing the sound pressure of an exhaust sound and its frequency distribution (shown by a histogram in the lower area of the graph). In FIG. 9, the vertical axis represents the sound pressure, the upper horizontal axis represents the frequency, and the lower horizontal axis represents the engine speed.

In FIG. 9, the solid lines show experimental data in the case that the exhaust muffler 1 according to this preferred embodiment is mounted, and the broken lines show experimental data in the case wherein the conventional exhaust muffler is mounted.

The upper two continuous lines (the solid line and the broken line) show changes in the sound pressure of an exhaust sound.

When the engine speed is in a high speed region (4000 to 9500 rpm), the sound pressure in the case wherein the exhaust muffler 1 according to this preferred embodiment is mounted is substantially the same as that in the case that the conventional exhaust muffler is mounted. However, when the engine speed is in a low speed region (1500 to 4000 rpm), the sound pressure in the case wherein the exhaust muffler 1 according to this preferred embodiment is mounted is slightly higher than that in the case that the conventional exhaust muffler is mounted. As to the frequency distribution (shown by the histogram in the lower area of the graph), the sound pressure at frequencies near 250 Hz in the case that the exhaust muffler 1 according to this preferred embodiment is mounted (the solid line) is higher than that in the case wherein the conventional exhaust muffler is mounted (the broken line), so that the timbre of the exhaust sound is improved.

As shown in FIG. 7, when the back pressure in the second expansion chamber 33 becomes high at high engine speeds, the exhaust gas in the second expansion chamber 33 is hard to discharge through the second tail pipe 42 to the outside of the exhaust muffler 1 because of the flow resistance in the second tail pipe 42 smaller in diameter than the second communication pipe 38. Accordingly, a part of the exhaust gas is inverted in a flowing direction to flow through the second communication pipe 38 into the third expansion chamber 35 and is next discharged through the first tail pipe 41 to the outside of the exhaust muffler 1.

With the configuration of this preferred embodiment, the engine output in a high engine speed region is improved over the prior art as shown in FIG. 8, and the sound pressure of the exhaust sound in a high engine speed region is substantially the same as that in the prior art as shown in FIG. 9. Thus, the engine output is increased with the sound pressure of the exhaust sound maintained in a high engine speed region according to this preferred embodiment. Further, the sound pressure of the exhaust sound in a low engine speed region is slightly higher than that in the prior art as shown in FIG. 9, thereby improving the timbre of the exhaust sound. The second tail pipe 42 is larger in diameter than the first tail pipe 41, and the difference in inner diameter between the second tail pipe 42 and the second communication pipe 38 is small. Accordingly, an exhaust resistance can be suppressed to ensure an engine output.

Further, the volume of the second expansion chamber 33 is larger than that of the third expansion chamber 35, so that the exhaust gas is reduced in pressure in the second expansion chamber 33. Accordingly, even when the exhaust gas is directly discharged from the second expansion chamber 33 through the second tail pipe 42 to the outside of the exhaust muffler 1, the exhaust sound can be reduced.

The sum of the opening area of the first tail pipe 41 and the opening area of the second tail pipe 42 is set substantially equal to the opening area of the rear end portion (input pipe) 36 of the connection pipe 3 in the exhaust muffler 1. Accordingly, the timbre of the exhaust sound in a low engine speed region can be improved and the engine output in a high engine speed region can also be increased.

While a specific preferred embodiment of the present invention has been described, it is apparent that the present invention is not limited to this preferred embodiment.

For example, as shown in FIGS. 6 and 7, the first partition wall 21 may be formed with a small hole 51 for communicating between the first expansion chamber 31 and the third expansion chamber 35. By forming the small hole 51, the back pressure acting on the second expansion chamber 33 can be finely adjusted.

Further, while the exhaust muffler 1 has such a structure wherein the flowing direction of the exhaust gas is inverted between the expansion chambers, it is needless to say that the present invention is applicable also to a muffler having such a structure that the flowing direction of an exhaust gas is not inverted.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An exhaust device for an internal combustion engine for discharging an exhaust gas from said internal combustion engine through a multistage expansion type muffler having a plurality of expansion chambers for silencing a sound of said exhaust gas during passage of said exhaust gas, comprising:

a first tail pipe for communicating between a most downstream one of said expansion chambers and an outside of said muffler; and a second tail pipe for communicating between an upstream one of said expansion chambers on an upstream side of said most downstream expansion chamber and the outside of said muffler, wherein said expansion chambers include first, second, and third expansion chambers arranged in the order of passage of said exhaust gas;

said most downstream expansion chamber is said third expansion chamber;

said upstream expansion chamber is said second expansion chamber; and a volume of said second expansion chamber is larger than a volume of said third expansion chamber, wherein said third expansion chamber is provided between said first expansion chamber and said second expansion chamber, and a small hole for adjusting a back pressure is formed through a partition wall between said first expansion chamber and said third expansion chamber.

2. The exhaust device for the internal combustion engine according to claim 1, wherein a sum of an opening area of said first tail pipe and an opening area of said second tail pipe is substantially equal to an opening area of an input pipe of said muffler so that a timbre of the exhaust sound in a low engine speed region is improved, and also so that an engine output in a high engine speed region is increased.

3. An exhaust device for the internal combustion engine for discharging an exhaust gas from said internal combustion engine through a multistage expansion type muffler having a plurality of expansion chambers for silencing a sound of said exhaust gas during passage of said exhaust gas, comprising:

a first tail pipe for communicating between a most downstream one of said expansion chambers and an outside of said muffler; and a second tail pipe for communicating between an upstream one of said expansion chambers on an upstream side of said most downstream expansion chamber and the outside of said muffler, wherein an opening area of said second tail pipe is formed to be larger than an opening area of said first tail pipe so that a timbre of the exhaust sound in a low engine speed region is improved, and also so that an engine output in a high engine speed region is increased.

4. The exhaust device for the internal combustion engine according to claim 3, wherein said expansion chambers include first, second, and third expansion chambers arranged in order of the passage of said exhaust gas;

said most downstream expansion chamber is said third expansion chamber;

said upstream expansion chamber is said second expansion chamber; and a volume of said second expansion chamber is larger than the volume a volume of said third expansion chamber.

5. The exhaust device for the internal combustion engine according to claim 3, wherein said expansion chambers include first, second, and third expansion chambers arranged in order of the passage of said exhaust gas, and said third expansion chamber is provided between said first expansion chamber and said second expansion chamber, and a small hole for adjusting a back pressure is formed through a partition wall between said first expansion chamber and said third expansion chamber.

6. The exhaust device for the internal combustion engine according to claim 3, wherein a sum of the opening area of said first tail pipe and the opening area of said second tail pipe is substantially equal to the opening area of an input pipe of said muffler so that a timbre of the exhaust sound in the low engine speed region is further improved, and also so that the engine output in the high engine speed region is further increased.

7. The exhaust device for the internal combustion engine according to claim 4, wherein a sum of the opening area of said first tail pipe and the opening area of said second tail pipe is substantially equal to the opening area of an input pipe of said muffler so that a timbre of the exhaust sound in the low engine speed region is further improved, and also so that the engine output in the high engine speed region is further increased.

8. An exhaust device adapted for use with an internal combustion engine for discharging an exhaust gas from said internal combustion engine, comprising:

a multistage expansion muffler having a plurality of expansion chambers including a most downstream expansion chamber and an upstream expansion chamber for silencing a sound of exhaust gas during passage of said exhaust gas;

a first tail pipe for communicating between the most downstream expansion chamber and outside of said muffler; and a second tail pipe for communicating between the upstream expansion chamber on an upstream side of said most downstream expansion chamber and the outside of said muffler, wherein a sum of an opening area of said first tail pipe and an opening area of said second tail pipe is substantially equal to an opening area of an input pipe of said muffler, thereby improving a timbre of the exhaust sound in a low engine speed region, and increasing an engine output in a high engine speed region.

9. The exhaust device adapted for use with the internal combustion engine according to claim 8, wherein the opening area of said second tail pipe is larger than the opening area of said first tail pipe.

10. The exhaust device adapted for use with the internal combustion engine according to claim 8, wherein said expansion chambers include first, second, and third expansion chambers arranged in order of the passage of said exhaust gas;

said most downstream expansion chamber is said third expansion chamber;

said upstream expansion chamber is said second expansion chamber; and the volume of said second expansion chamber is larger than the volume of said third expansion chamber.

11. The exhaust device adapted for use with the internal combustion engine according to claim 9, wherein said expansion chambers include first, second, and third expansion chambers arranged in order of the passage of said exhaust gas;

said most downstream expansion chamber is said third expansion chamber;

said upstream expansion chamber is said second expansion chamber; and the volume of said second expansion chamber is larger than the volume of said third expansion chamber.

12. The exhaust device adapted for use with the internal combustion engine according to claim 8, wherein said expansion chambers include first, second, and third expansion chambers arranged in order of the passage of said exhaust gas, and said third expansion chamber is provided between said first expansion chamber and said second expansion chamber, and a small hole for adjusting a back pressure is formed through a partition wall between said first expansion chamber and said third expansion chamber.

13. The exhaust device adapted for use with the internal combustion engine according to claim 9, wherein said expansion chambers include first, second, and third expansion chambers arranged in order of the passage of said exhaust gas, and said third expansion chamber is provided between said first expansion chamber and said second expansion chamber, and a small hole for adjusting a back pressure is formed through a partition wall between said first expansion chamber and said third expansion chamber.

14. The exhaust device adapted for use with the internal combustion engine according to claim 10, wherein said expansion chambers include first, second, and third expansion chambers arranged in the order of the passage of said exhaust gas, and said third expansion chamber is provided between said first expansion chamber and said second expansion chamber, and a small hole for adjusting a back pressure is formed through a partition wall between said first expansion chamber and said third expansion chamber.

15. The exhaust device adapted for use with the internal combustion engine according to claim 8, wherein the opening area of said second tail pipe is larger than the opening area of said first tail pipe, thereby further improving the timbre of the exhaust sound in the low engine speed region, and further increasing the engine output in the high engine speed region.

16. The exhaust device adapted for use with the internal combustion engine according to claim 9, wherein the opening area of said second tail pipe is larger than the opening area of said first tail pipe, thereby further improving the timbre of the exhaust sound in the low engine speed region, and further increasing the engine output in the high engine speed region.

* * * * *